US005193880A

United States Patent [19]

Keusch et al.

[11] Patent Number: 5,193,880

[45] Date of Patent: Mar. 16, 1993

[54] CHAIR, IN PARTICULAR WORK OR OFFICE CHAIR

[75] Inventors: Siegfried Keusch, Plochingen; Gunter Kratz, Hochdorf, both of Fed. Rep. of Germany

[73] Assignee: Roeder GmbH, Fed. Rep. of Germany

[21] Appl. No.: 536,626

[22] PCT Filed: Dec. 10, 1988

[86] PCT No.: PCT/DE88/00757

§ 371 Date: Aug. 28, 1990

§ 102(e) Date: Aug. 28, 1990

[87] PCT Pub. No.: WO89/06100

PCT Pub. Date: Jul. 13, 1989

[30] Foreign Application Priority Data

Dec. 29, 1987 [DE] Fed. Rep. of Germany ..... 3744365

[51] Int. Cl.[5] ..... A47C 3/00

[52] U.S. Cl. ..... 297/353; 297/340; 297/296

[58] Field of Search ..... 297/300, 341, 342, 343, 297/301, 353, 296

[56] References Cited

U.S. PATENT DOCUMENTS

| | | | |
|---|---|---|---|
| 2,471,024 | 5/1949 | Cramer | 155/77 |
| 2,558,171 | 6/1951 | Chesley | 155/163 |
| 3,632,165 | 1/1972 | Miller | 297/343 X |
| 3,989,297 | 11/1976 | Kerstholt | 297/300 |
| 4,362,336 | 2/1982 | Zapf et al. | 297/343 X |
| 4,452,486 | 6/1984 | Zapf et al. | 297/341 X |
| 4,502,729 | 3/1985 | Locher | 297/343 X |
| 4,684,173 | 8/1987 | Locher | 297/300 |
| 5,100,200 | 3/1992 | Keusch et al. | 297/296 |

FOREIGN PATENT DOCUMENTS

| | | | |
|---|---|---|---|
| 0085670 | 3/1985 | European Pat. Off. . | |
| 0176816 | 9/1985 | . | |
| 2916897 | 11/1980 | Fed. Rep. of Germany . | |
| 8300610 | 3/1983 | PCT Int'l Appl. . | |
| 173772 | 12/1922 | United Kingdom | 297/343 |
| 593542 | 10/1947 | United Kingdom | 297/341 |

*Primary Examiner*—Kenneth J. Dorner
*Assistant Examiner*—Milton Nelson, Jr.
*Attorney, Agent, or Firm*—Speckman & Pauley

[57] ABSTRACT

A chair, in particular a work or office chair, having a backrest rod adjustable in inclination with respect to a seat and a backrest slidable thereon, which can be displaced with an adjustment device when the backrest rod is tilted backward in the direction of the seat. The adjustment device has a single knee lever which is pivotally seated around a horizontal pivot axis on a bracket supporting the seat or on a seat support on the bracket. The tilt of the bracket or the seat support can be adjusted. An extension of the backrest is flexibly connected with one end of the arm of the knee lever. One end of another lever arm of the knee lever is pivotal with a retaining bolt of the backrest rod or the seat support in such a way that during backward tilt of the backrest rod or lowering of the seat support, the one lever arm of the knee lever displaces the extension and the backrest in a direction toward the bracket or the seat support.

20 Claims, 4 Drawing Sheets

CHAIR, IN PARTICULAR WORK OR OFFICE CHAIR

BACKGROUND OF INVENTION

1. Field of the Invention

This invention relates to a chair, in particular a work or office chair, with a backrest rod adjustable in inclination with respect to the seat and a backrest slideable thereon, which can be displaced with an adjustment device when the backrest rod is tilted backward in the direction of the seat.

2. Description of Prior Art

The known chairs of this type offer excellent seating comfort because, on the one hand, they provide a definite support of the back of the user in the initial or working position as a result of the practically vertical position of the backrest and, on the other hand, permit relaxed sitting when the backrest rod is tilted back. When the backrest rod is tilted back, the upper torso of the user does not simply perform a pivot motion, but there is motion in which several movement components are superimposed on each other. Because the backrest performs an additional downward movement when the backrest rod is tilted back, relative movement between the back of the user and the backrest is avoided or at least reduced to a point which is no longer noticeable.

As shown in European patent applications 0,085,670 A1 and 0,176,816 A1 and German patent application 2,916,897 A1, compensation of the relative movement between the body of the user and the backrest can be attained in different types of chairs in constructively different ways. The chair may be a synchronized chair, in which a downward tilt of the seat carrier supporting the seat causes a forced backward tilt of the backrest rod with a larger tilt angle. It is also possible to make the seat carrier so that it can be slid out from the bracket. As taught by these known chairs, an expensive and complicated adjustment device, which does not always operate trouble-free and operationally safe, is always required for compensation of the relative movement between the body of the user and the backrest, which occurs when the tilt of the backrest rod is changed.

Either multi-link lever chains are used, as shown in European patent application 0,176,816 A1 or pairs of transmission levers and carrier elements are used, as shown in European patent application 0,085,870 A1. In this case many parts are required for the adjustment device. The same is true for a chair taught by German patent application 2,916,897 A1, in which the backrest is displaced on the backrest rod in the direction towards the seat when the seat is pulled out.

SUMMARY OF THE INVENTION

It is one object of this invention to provide a chair of the previously mentioned type in which the adjustment device for the compensation of the relative movement between the body of the user and the backrest, when the backrest rod tilts backwards, requires a minimum of assembly and parts, the type of the chair, fixed, sliding or tiltable, has no effect on the design of the adjustment device and the adjustment device operates safely.

This object is achieved in accordance with this invention where the adjustment device has only a single knee lever, which is pivotally seated around a horizontal pivot axis on a bracket supporting the seat or on a seat support on the bracket. The tilt can be changed through an extension of the backrest flexibly connected with the end of the first lever arm of the knee lever. The end of the second lever arm of the knee lever is pivotable around a retaining bolt or the like of the backrest rod and/or of the seat support such that during the backward tilt of the backrest rod and/or the lowering of the seat support, the first lever arm of the knee lever displaces the extension and, thus, the backrest, in the direction toward the bracket or the seat support.

The adjustment device is limited to a single knee lever which is pivotably seated on the fixed bracket of the chair or on the seat support which is flexibly connected to the bracket. The connection with the backrest is relatively simple, because an extension thereof is directly linked with first lever arm of the knee lever. The pivot movement of the knee lever, and thus the displacement movement of the backrest on the backrest rod initiated through the second lever arm of the knee lever, may be initiated through the backrest rod itself or through the seat support, the tilt of which is adjustable.

Linkage of the extension of the backrest with the knee lever is provided, in accordance with one embodiment, in such a way that the extension of the backrest ends in a seating sleeve which is rotatably seated on a hinge bolt of first lever arm of the knee lever and the hinge bolt of the first lever arm of the knee lever and the linked end of the extension have a common path of movement, during the pivot movement of the knee lever and the tilt movement of the backrest rod comprising an arc on a circular path around the horizontal pivot axis of the knee lever.

In accordance with one embodiment, the connection of this invention to the backrest is provided by the extension of the backrest rigidly connected by a connecting strap to a slide which is displaceable on or in the backrest rod, or is of one piece therewith. The slide directly supports the backrest if no additional manual pre-setting of the backrest on the backrest rod is provided.

A sufficiently large pivot movement of the knee lever is achieved when the backrest rod is tilted back where the hinge bolt for the flexible connection between the first lever arm of the knee lever and the extension is positioned on the bracket or the seat support between the horizontal pivot axis of the knee lever and the pivot axis of the backrest rod. In the initial position, straight up, of the backrest rod, the first lever arm of the knee lever extends approximately horizontally, as does the bracket or the seat support.

An absolutely rigid connection between the backrest and the knee lever is provided when the retaining bolt is positioned on the backrest rod and, when the backrest rod is tilted backwards, describes a path of movement located on a circular path around the pivot axis of the backrest rod on the bracket or the seat support. The retaining bolt is adjustably guided in a guide slit of the second lever arm of the knee lever for compensation of the changing distance from the horizontal pivot axis of the knee lever. In connection with this embodiment, it is preferred that the retaining bolt is seated in a sliding block which is adjustably guided in the guide slit of the second lever arm of the knee lever in order to obtain a sliding movement between the retaining bolt and the knee lever which does not make much noise.

In accordance with another embodiment of this invention, the adjustment path of the backrest on the backrest rod can be affected and adapted as required because the longitudinal center axis of the guide slit in the second lever arm has been offset by a set amount from the horizontal pivot axis of the knee lever in the direction toward the hinge bolt for the extension of the backrest of the first lever arm of the knee lever. The two arms of the knee lever form an obtuse angle towards the support surface of the chair.

With a seat support linked to the bracket and adjustable in its tilt, the retaining bolt is additionally adjustably guided in guide slits which extend approximately horizontally, so that, when the seat support is lowered and the knee lever pivoted, the retaining bolt can be adjusted with respect to the seat support and the bracket such that it can perform its movement on a path around the pivot axis of the backrest rod, on the seat support, without hindrance.

In another embodiment according to this invention, the same effect is achieved when the knee lever is pivotally seated on the end of the bracket facing towards the backrest, because the backrest rod is pivotably seated on the bracket between the horizontal pivot axis of the knee lever and the pivot axis of the seat support and above the connecting line between these two pivot axes. The second lever arm adjustably receives the retaining bolt of the backrest rod in a guide slit and the retaining bolt is additionally guided in approximately horizontal guide slits of the bracket. In this connection, a sufficiently large adjustment path of the backrest on the backrest rod is achieved when the first lever arm of the knee lever is positioned below the second arm of the knee lever and when the two lever arms form an acute angle towards the backrest rod.

If the backrest is fixed on a cradle, which is adjustable on the slide and which can be locked on the slide in several positions, it is possible to set the backrest in an initial position when the backrest rod is in an upright position, which can be adapted to the body size of the user. As a result, the displacement path of the backrest occurring when the backrest rod is tilted backward always begins from the selected initial position of the backrest.

The manual change of the initial position of the backrest on the backrest rod is facilitated by a spring with a lock bolt fixed on the cradle which can engage one or a plurality of bores of the slide. With a key positioned in the backrest rod, the spring can be released and the locked connection between the lock bolt and the slide can be interrupted. When the key is pressed, the cradle with the backrest can be displaced on the slide. If the key is released, the lock bolt will lock in the next bore of the slide because of the tension of the spring.

The displacement path of the cradle on the slide can be changed or affected due to the relationship of the distance of the retaining bolt from the pivot axis of the knee lever to the distance of the hinge bolt for the extension of the backrest to the pivot axis of the knee lever which enables the adjustment path of the slide on the backrest rod, and thus of the backrest, to be fixed.

BRIEF DESCRIPTION OF THE DRAWINGS

The invention will be described in detail by various embodiments shown in the drawings wherein.

DESCRIPTION OF THE PREFERRED EMBODIMENTS

Figure 1:
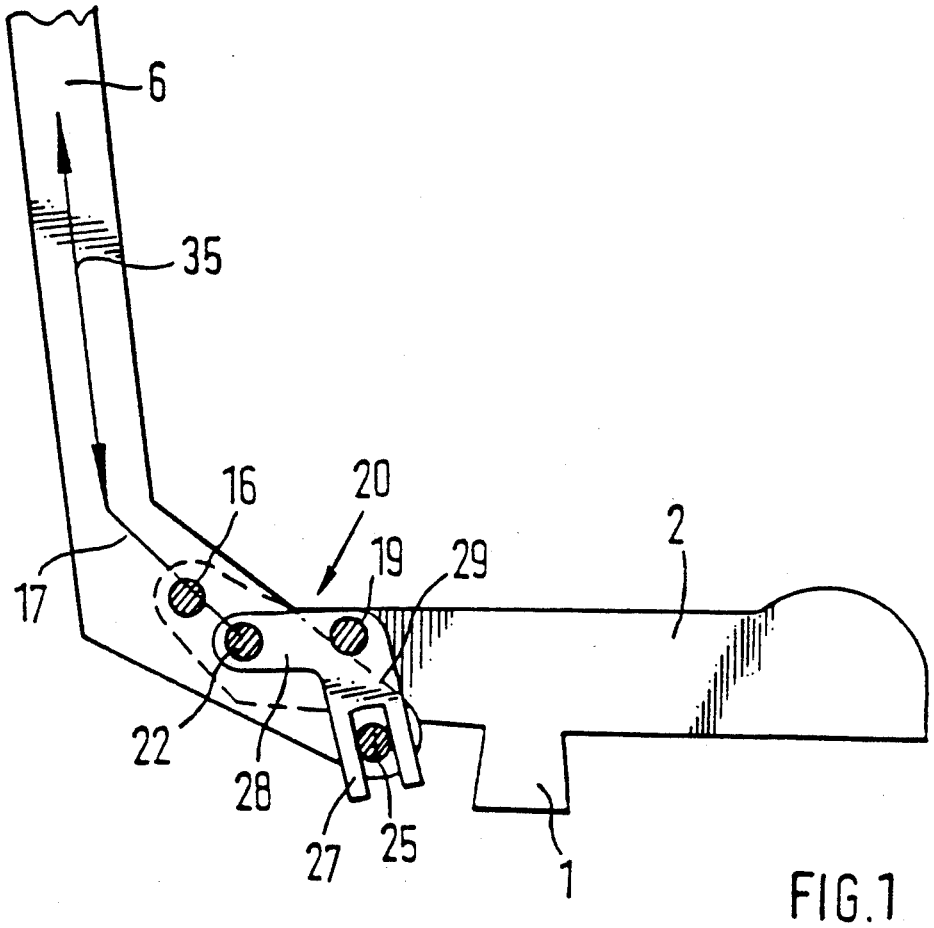
FIG. 1 is a schematic view of a simple chair with an adjustment device, wherein only the backrest rod can be changed in its tilt with respect to the seat.

FIG. 1 shows a schematic view of the parts of a chair required for the compensation of the relative movement between the body of the user and the backrest. In this case it has been assumed that this is a simple chair, wherein the seat is fastened to the bracket 2, which is fixedly connected with the column 1 of the base frame of the chair and wherein it is only possible to change the tilt of the backrest rod 6 with respect to the seat. Manually operated devices may be provided to change the tilt of the backrest rod 6. A change of the tilt, however, can also be accomplished by displacement of the weight of the user, where known inclination mechanisms with springs or the like may be used.

The backrest rod 6 is pivotally seated on the pivot axis 16 on the end of the bracket 2 on the side of the backrest. The backrest rod 6 is extended beyond the pivot axis 16 and supports the retaining bolt 25. As shown by means of the horizontal pivot axis 19, the knee lever 20 is pivotally seated on the bracket 2, offset in relation to the pivot axis 16 in the direction of the side of the seat towards the knees. In an initial position, when the backrest rod points straight up, the first lever arm 28 of the knee lever 20 extends approximately horizontally and points in the direction towards the pivot axis 16 of the backrest rod 6. The extension 17 of the backrest, indicated by 35, which in the simplest case may be of one piece with the backrest 35, is linked to the hinge bolt 22 on first end of the one lever arm 28. The second lever arm 29 of the knee lever 20 forms an obtuse angle in the direction of the surface on which the chair rests with the first lever arm 28 of the knee lever 20. A longitudinally oriented guide slit 27 is formed in the second lever arm 29, in which the retaining bolt 25 can be displaced. If the backrest rod 6 is moved backward, the retaining bolt 25 describes a path of movement around the pivot axis 16, which is located on a circular path. In such course, the retaining bolt 25 displaces the second lever arm 29 of the knee lever 20 in a counterclockwise direction. The guide slit 27 is provided so that the retaining bolt 25 can be displaced in the direction towards the pivot axis 19 of the knee lever 20. When displacing the retaining bolt 25 counterclockwise, the distance towards the pivot axis 19 of the knee bolt 20 decreases. In the course of its pivot movement, the first lever arm 28 of the knee lever 20 displaces the extension 17 of the backrest 35 on the backrest rod 6 in the direction towards the seat, as indicated by the arrows. In this connection it is important that in the course of the backward tilt of the backrest rod 6, the end of the extension 17 and the hinge bolt 22 of the one lever arm 28 of the knee lever 20 move on a common movement path which is defined by the circular path on which the hinge bolt 22 moves around the pivot axis 19 of the knee lever 20. Then by appropriate design of the knee lever 20, the backrest 35 can be rigidly connected with the knee lever 20 through the extension 17 and only the linkage of the extension 17 with the hinge bolt 22 is required.

Figure 2:
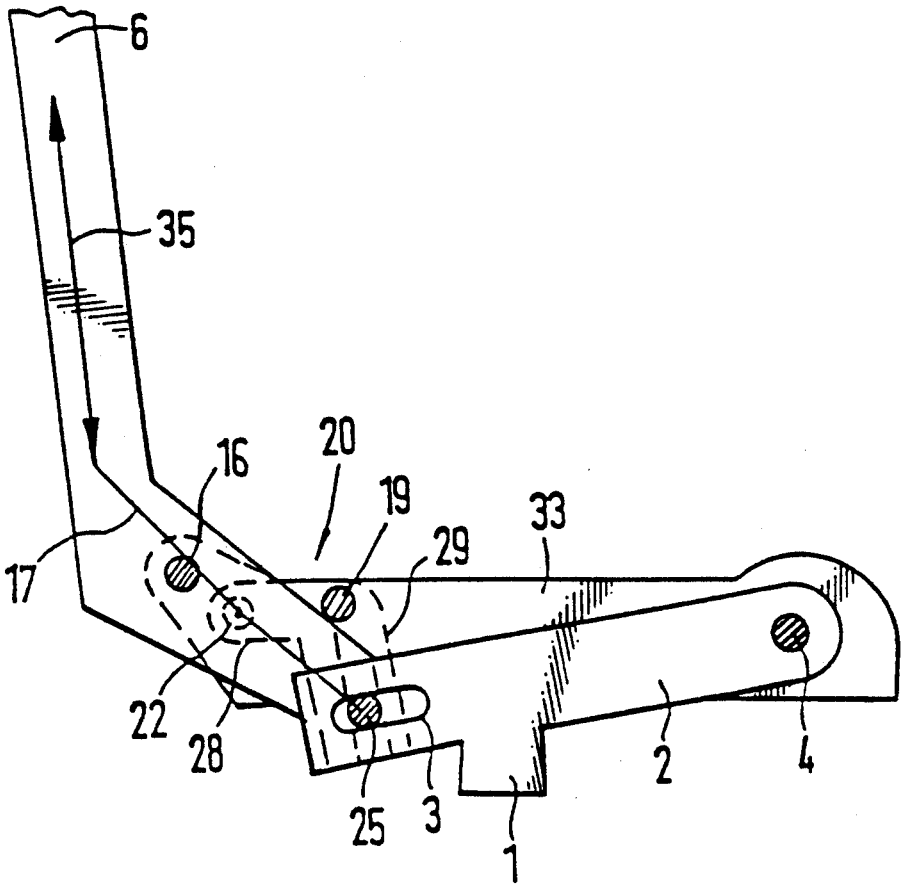
FIG.2 is a schematic view of a synchronized chair with an adjustment device, wherein forced increased backward tilt of the backrest rod is connected with the lowering of the seat support.

In FIG. 2, a synchronized chair is shown, in which forced increased backward tilt of the backrest rod 6 occurs with the lowering of the seat support 33, where the pivot angle of the backrest rod 6 is larger in each case than the pivot angle of the seat support 33. The seat support 33 can be changed in its tilt around the horizontal pivot axis 19 at the end of the bracket 2 oriented towards the knees. Now the knee lever 20 is pivotally seated with its pivot axis 19 on the seat support 33. Again the linkage of the extension 17 with the backrest 35 is obtained through the hinge bolt 22 on the first lever arm 28 of the knee lever 20. The retaining bolt 25 of the backrest rod 6 again is adjustably guided in the guide slit of the second lever arm 29 of the knee lever 20. Also, approximately horizontal guide slits 3 are provided in the bracket 2, which additionally guide the retaining bolt 25. If the seat support 33 is pivoted downward, i.e. counterclockwise, around the pivot axis 4, the retaining bolt 25 is displaced in the guide slit 27 of the second lever arm 29 of the knee lever 20 as well as in the guide slits 3 of the bracket 2. In this case the knee lever 20 is pivoted counterclockwise, which leads to a downward movement of the backrest 35 on the backrest rod 6. The path of movement of the end of the extension 17 during the backward tilting of the backrest rod 6 and the path of movement of the hinge bolt 22 on the first lever arm 28 of the knee lever 20 again are matched with each other such that they are superimposed on each other. As a result, a rigid coupling between the extension 17 and the backrest 35 becomes possible. In connection with this invention, no detailed mention is being made of the spring arrangement in the chair and the inclination mechanism for the seat support 33, because they are of no importance for the adjustment device of the backrest and can be designed in a known manner.

Figure 3:
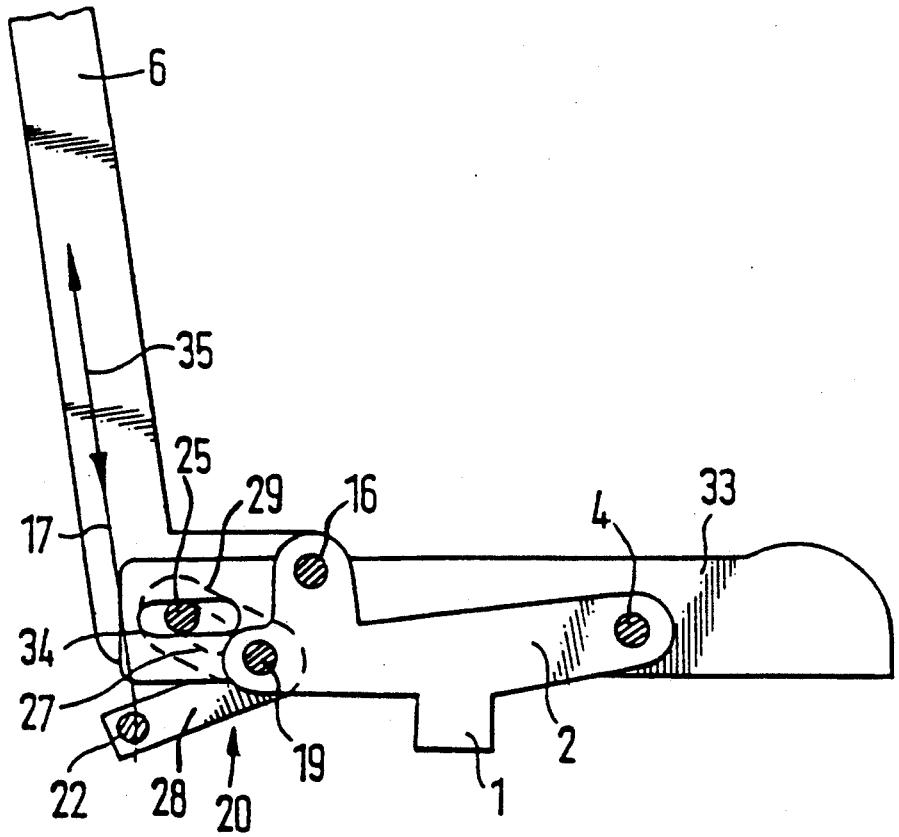
FIG. 3 is a schematic view of a synchronized chair with another design and coupling of the knee lever of the adjustment device.

Another synchronized chair is schematically shown in FIG. 3, in which an adjustment device with only a single knee lever 20 also is employed, but which is coupled in a different way to the backrest rod 6 and the bracket 2 of the chair. On the end of the bracket 2 toward the knees of the user, the seat support 33 is pivotally seated around the pivot axis 4. On the end of the seat support 33 towards the backrest, the backrest rod 6 is pivotally seated around the horizontal pivot axis 16 and the knee lever 20 around the pivot axis 19. In this case the pivot axis 16 of the backrest rod 6 is located between the pivot axes 4 and 19, as well as above the connecting line between the pivot axes 4 and 19. The first lever arm 28 with the hinge bolt 22 again is connected with the backrest 35 through the extension 17, but in this embodiment is located below the second lever arm 29 and forms an acute angle with it in the direction towards the backrest rod 6. The knee lever 20 faces the backrest rod 6 and again adjustably receives the retaining bolt 25 of the backrest rod 6 in the guide slit of the second lever arm 29. In addition, the retaining bolt 25 is adjustably guided in guide slits 34 of the seat support 33, extending approximately horizontally, so that in the course of lowering of the seat support 33 and pivoting of the backrest rod 6, the retaining bolt 25 can appropriately change the distance to the pivot axis 19 of the knee lever 20. A forced synchronous change of the tilt of the seat support 33 and the backrest rod 6 is achieved by the coupling of the seat support 33 and the backrest rod 6 through the retaining bolt 25 where, because of the placement of the pivot axis 16 and the retaining bolt 25, the pivot angle of the backrest rod 6 around the pivot axis 16 is always greater than the associated pivot angle of the seat support 33 around the pivot axis 4. Because the retaining bolt 25 is also coupled with the knee lever 20, the pivot angle of the knee lever 20 and, with it, the displacement movement of the backrest 35, is forcibly connected to the pivot movement of the seat support 33 around the pivot axis 4. In this case, the pivot movements of the seat support 33, backrest rod 6 and knee lever 20 can be matched to each other in such a way that the optimum movements of the seat support 33, backrest rod 6 and knee lever 20 are achieved.

Figure 4:
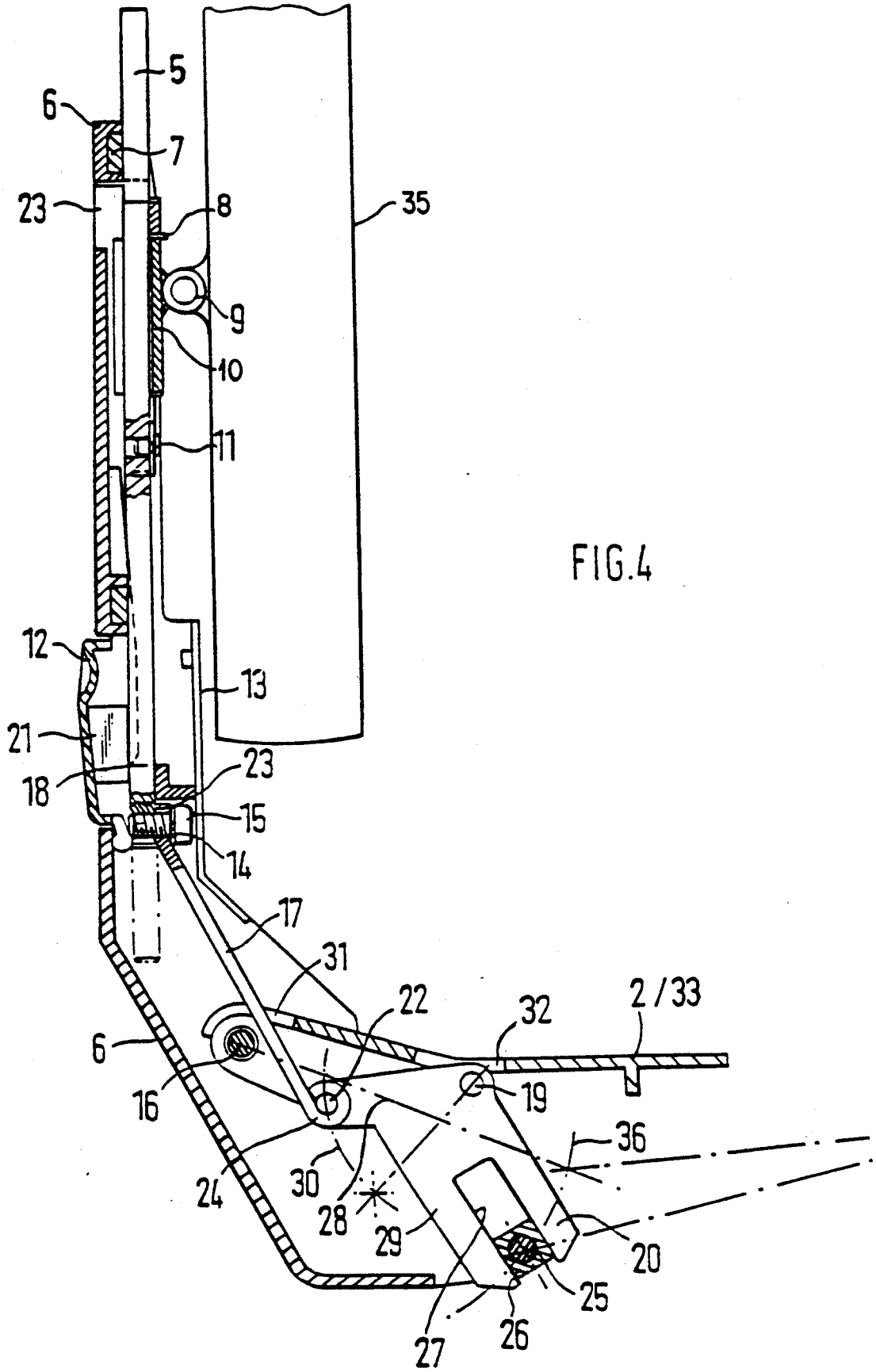
FIG. 4 is a partial longitudinal cross-sectional view of the adjustment device with the backrest rod and the seat support for a chair in accordance with FIGS. 1 and 2.
Figure 5:
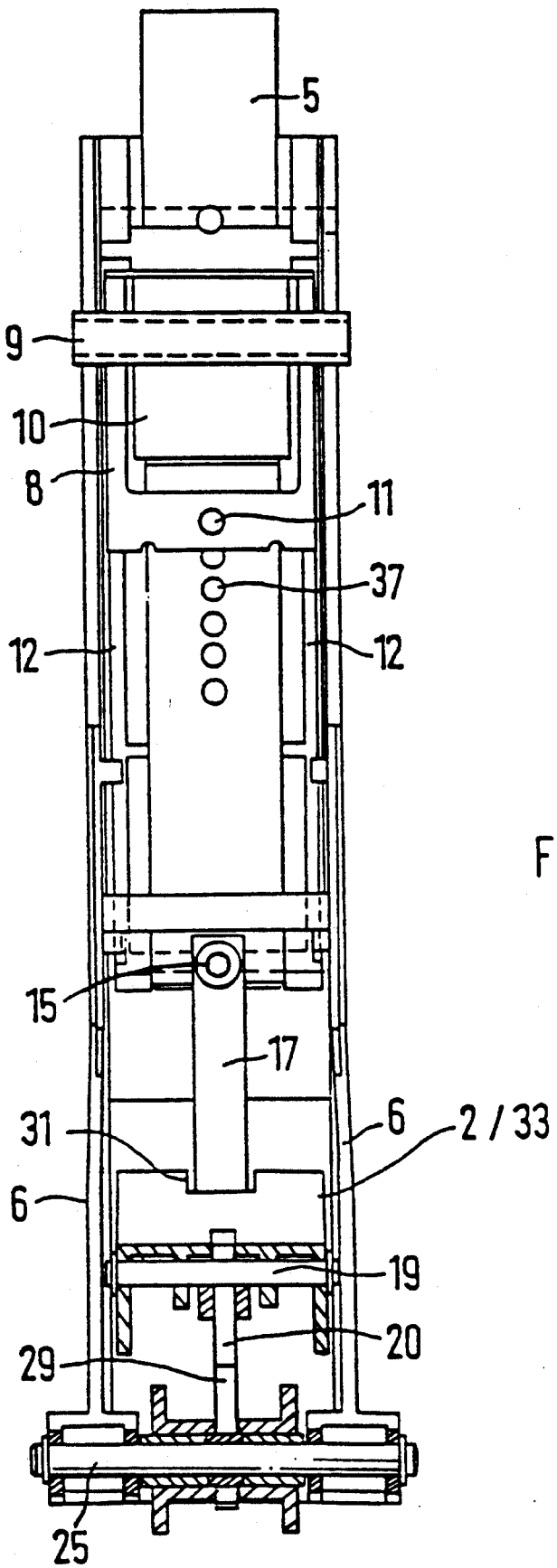
FIG. 5 a partial cross-sectional view of the side of the adjustment device facing the backrest, with the backrest rod and the seat support.

The structural details of one embodiment of the adjustment device for a chair in accordance with FIG. 1 or FIG. 2 are shown in FIGS. 4 and 5, the illustration being limited to those parts necessary for the differentiation of the adjustment path of the backrest on the backrest rod 6. In FIG. 4, the knee lever 20 may be pivotally seated either on the bracket 2 or the seat support 33. In this case, the pivot axis 19 is in the form of a bearing bolt, U-shaped in cross section, seated in the annular arms of a bracket 2 or seat support 33. The opening 32 provides space for the knee lever 20, so that it is possible to keep the structural height of the bracket 2 or the seat support 33 relatively low. The backrest rod 6 also has lateral arms and is open towards the backrest. The bracket 2 or the seat support 33 extends between the lateral arms of the backrest rod 6 and is rotatably seated there by the pivot axis 16 in the form of a seating bolt. The bracket 2 or the seat support 33 has a recess 31 in the area of its seating, through which the extension 17 is routed and is flexibly seated on the hinge bolt 22 by the seating sleeve 24. The hinge bolt 22 is positioned at the end of the first lever arm 28 which, in an initial position of the chair, with the backrest rod 6 straight up, extends approximately horizontally, as does the bracket 2 or the seat support 33. In the area of the backrest rod 6 extended beyond the pivot axis 16, the retaining bolt 25 is fixed in a sliding block 26. The sliding block 26 is adjustably guided in the guide slit 27 of the second lever arm 29 of the knee lever 20. During pivoting of the knee lever 20, the hinge bolt 22 defines a movement path 30 extending on a circular path around the pivot axis 19 of the knee lever 20. The matching of the pivot movement of the backrest rod 6 now is such that the seating sleeve 24 of the extension 17 of the backrest defines a movement path which coincides with and is identical to the movement path of the hinge bolt 22. The rigid connection of the extension 17 with the parts supporting the backrest can now be achieved. An appropriate matching can now be performed with the placement of the first and second lever arms 28 and 29 of the knee lever 20 and the distance of the hinge bolt 22 and the retaining bolt 25 from the pivot axis 19 of the knee lever 20. The distance of the pivot axes 16 and 19 on the bracket 2 or the seat support 33 is also a parameter which can be used for fixing the adjustment path of the backrest. Therefore the extension 17 can be fixedly connected with the slide 5, which is adjustably guided in the backrest rod 6, through the connecting strap 23, the bolt 15 and the spring washer 14. During pivoting of the backrest rod 6, the retaining bolt 25 defines the movement path 36 located on a circular path around the pivot axis 16. As shown in FIG. 4, when the backrest rod 6 is pivoted counterclockwise, the second lever arm 29 of the knee lever 20 is pivoted by the retaining bolt 25 in the same direction. In this case, the distance of the retaining bolt 25 from the pivot axis 19 of the knee lever 20 changes. As a result, the retaining bolt 25, disposed in the sliding block 26, is guided longitudinally adjustable in the guide slit 27 of the second lever arm 29, so as to be able to make its pivot movement on the movement path 36 without hindrance. Outside of the adjustment area of the cradle 10, the cover 13 covers a part of the open side of the backrest rod 6.

If the knee lever 20 is pivotally seated on the seat support 33, the retaining bolt 25 is also adjustably guided in guide slits 3 of the bracket 2, as can be seen from FIG. 2.

The cradle 10 is adjustably guided on the slide 5. The cradle 10 has a horizontally oriented tube section 9 on which the backrest 35 is fixed. A spring 8 is positioned between the slide 5 and the cradle 10 and fixed on the cradle 10. The cradle 10 surrounds the slide 5 and is supported with a cross arm on the side of the slide 5 facing the backrest, as indicated in FIG. 5. The cross arm supports the lock bolt 11, which is locked in a bore 37 of the row of holes in the slide 5.

On the side of the backrest rod 6 facing away from the backrest a key 12 is disposed, supported on the slide 5 with an elastic element 21 that acts as a restoring spring. The side of the elastic element 21 facing the slide 5 is covered with an adhesive foil 18, which improves the sliding of the slide 5 on the elastic element 21. The key 12 extends with extensions on both sides of the slide 5 as far as the cradle 10, which is in its topmost position of engagement, and extends behind the spring 8, so that by pressure on the key 12, the spring 8 is disengaged and the locked connection between the lock bolt 11 and the slide 5 can be interrupted. Thus the backrest can be brought manually into an initial position on the slide 5, which can be selected in the area of the slide 5 with the row of holes. In the course of backward tilting of the backrest rod 6, the displacement path from the initial position of the backrest set by the knee layer 20 is executed, independently of the selected initial position. The slide 5 is guided on damping elements 7 inserted into the backrest rod 6, which prevent adjustment noises when the slide 5 is displaced. The cover 13 covers the side of the backrest rod 6 facing the backrest at least outside of the cradle 10, in which connection the maximum displacement path of the cradle 10, which results from the manual adjustment of the slide 5 and the adjustment path of the slide 5, must be taken into consideration. The position of the backrest is adapted to the body size of the user by means of the manual adjustment of the cradle 10 on the slide 5. The adjustment is preformed with the backrest rod 6 in the upright position.

We claim:

1. In a chair having a backrest rod adjusting in inclination with respect to a seat and a backrest slideable thereon, which can be displaced with an adjustment device, when the backrest rod is tilted backward, in a seat direction of the seat, the improvement comprising:

the adjustment device having a single knee lever (20) adjacent to said backrest rod, which is pivotally seated around a horizontal pivot axis (19) on one of a bracket (2) supporting the seat and a seat support (33) on the bracket (2), a tilt of which can be adjusted, an extension (17) of the backrest (35) flexibly connected to a first end of a first lever arm (28) of said knee lever (20), and a second end of a second lever arm (29) of said knee lever (20) is guided by a retaining bolt (25) seated on the backrest rod (6) in such a way, that during backward tilt of the backrest rod (6) said first lever arm (28) of said knee lever (20) displaces said extension (17) and the backrest (35) in a first direction toward said bracket (2) said retaining bolt (25) defines a path of movement (36) on a circular path around a pivot axis (16) of said backrest rod (6) at said bracket (2), and said retaining bolt (25) is adjustably guided in a guide slit (27) of said second lever arm (29) of said knee lever (20), compensating for a changing distance to said horizontal pivot axis (19) of said knee lever (20).

2. In a chair in accordance with claim 1, wherein because of a relationship of a first distance of said retaining bolt (25) from said horizontal pivot axis (19) of the knee lever (20) to a second distance of a hinge bolt (22) for said extension (17) of the backrest to said horizontal pivot axis (19) of the knee lever (20), an adjustment path of a slide (5) on the backrest rod (6), and thus of the backrest (35) can be fixed.

3. In a chair in accordance with claim 1, wherein the backrest (35) is fixed on a cradle (10), which is adjustable on a slide (5) and which can be locked on said slide (5) in a plurality of positions.

4. In a chair in accordance with claim 1, wherein a hinge bolt (22) is positioned on said bracket (2) between said horizontal pivot axis (19) of the knee lever (20) and said pivot axis (16) of the backrest rod (6).

5. In a chair in accordance with claim 1, wherein in connection with said seat support (33) linked to the bracket (2) and adjustable in inclination, said retaining bolt (25) is additionally guided adjustably in guide slits (3) of the bracket (2), which extend approximately horizontally.

6. In a chair in accordance with claim 1, wherein said extension (17) of the backrest (35) is rigidly connected with a connecting strap (23) with a slide (5), which is displaceable with respect to the backrest rod (6).

7. In a chair in accordance with claim 1, wherein said extension (17) of the backrest (35) ends in a seating sleeve (24) which is rotatably seated on a hinge bolt (22) of said first lever arm (28) of said knee lever (20).

8. In a chair in accordance with claim 7, wherein said extension (17) of the backrest (35) is rigidly connected with a connecting strap (23) with a slide (5), which is displaceable with respect to the backrest rod (6).

9. In a chair in accordance with claim 8, wherein said hinge bolt (22) is positioned on said bracket (2) between said horizontal pivot axis (19) of the knee lever (20) and said pivot axis (16) of the backrest rod (6).

10. In a chair in accordance with claim 4, wherein a longitudinal center axis of said guide slit (27) in said second lever arm (29) is offset in a direction toward said hinge bolt (22), and said first and second lever arms (28, 29) of the knee lever (20) form an obtuse angle towards a support surface of the chair.

11. In a chair in accordance with claim 9, wherein said retaining bolt (25) is seated in a sliding block (26) which is adjustably guided in said guide slit (27) of said second lever arm (29) of the knee lever (20).

12. In a chair in accordance with claim 11, wherein a longitudinal center axis of said guide slit (27) in said second lever arm (29) is offset in a direction toward said hinge bolt (22), and said first and second lever arms (28, 29) of the knee lever (20) form an obtuse angle towards a support surface of the chair.

13. In a chair in accordance with claim 12, wherein in connection with said seat support (33) linked to the bracket (2) and adjustable in inclination, said retaining bolt (25) is additionally guided adjustably in guide slits (3) of the bracket (2), which extend approximately horizontally.

14. In a chair in accordance with claim 1, wherein the knee lever (20) is pivotally seated on a bracket end of said bracket (2) facing towards the backrest (35), said backrest rod (6) is pivotally seated on said bracket (2) between said horizontal pivot axis (19) of the knee lever (20) and a seat pivot axis (4) of said seat support (33) and above a connecting line between said seat pivot axis (4) and said horizontal pivot axis (19), said second lever arm (29) adjustably receives said retaining bolt (25) of the backrest rod (6) in said guide slit (27), and said retaining bolt (25) is additionally guided in approximately horizontal guide slits (34) of said seat support (33).

15. In a chair in accordance with claim 14, wherein said first lever arm (28) of the knee lever (20) is positioned below said other arm (29) of the knee lever (20), and said two lever arms (28, 29) form an acute angle towards the backrest rod (6).

16. In a chair in accordance with claim 15, wherein the backrest (35) is fixed on a cradle (10), which is adjustable on said slide (5) and which can be locked on said slide (5) in a plurality of positions.

17. In a chair in accordance with claim 16, wherein said cradle (10) is supported on said slide (5) with an elastic element acting as a restoring spring and is brought by extension behind said spring (8).

18. In a chair in accordance with claim 11, wherein a spring (8) with a lock bolt (11) is fixed on said cradle (10) which can engage with at least one bore (37) of said slide (5), and with a key (12) positioned in the backrest rod (6) said spring (8) can be released and in this way interrupt the locked connection between said lock bolt (11) and said slide (5).

19. In a chair in accordance with claim 18, wherein said cradle (10) is supported on said slide (5) with an elastic element acting as a restoring spring and is brought by extension behind said spring (8).

20. In a chair in accordance with claim 19, wherein because of a relationship of a first distance of said retaining bolt (25) from said horizontal pivot axis (19) of the knee lever (20) to a second distance of said hinge bolt (22) for said extension (17) of the backrest to said horizontal pivot axis (19) of the knee lever (20), an adjustment path of said slide (5) on the backrest rod (6), and thus of the backrest (35) can be fixed.

* * * * *